US006095106A

United States Patent [19]

Kaluris

[11] Patent Number: 6,095,106

[45] Date of Patent: Aug. 1, 2000

[54] CYCLO-VALVE FOR INTERNAL COMBUSTION ENGINES

[76] Inventor: Emmanuel Kaluris, 2931 Hidden Hollow La., Davie, Fla. 33328

[21] Appl. No.: 09/363,981

[22] Filed: Jul. 28, 1999

[51] Int. Cl.[7] ..... F01L 7/00

[52] U.S. Cl. ..... 123/190.1; 123/190.14

[58] Field of Search ..... 123/190.1, 190.14

[56] References Cited

U.S. PATENT DOCUMENTS

| | | | |
|---|---|---|---|
| 4,976,227 | 12/1990 | Draper | 123/80 R |
| 4,989,576 | 2/1991 | Coates | 123/80 D |
| 5,417,188 | 5/1995 | Schiattino | 123/190.2 |
| 5,524,579 | 6/1996 | Eluchans | 123/79 R |

FOREIGN PATENT DOCUMENTS

| | | | |
|---|---|---|---|
| 62-265413 | 11/1987 | Japan | 123/190.14 |

*Primary Examiner*—Marguerite McMahon
*Assistant Examiner*—Katrina B. Harris
*Attorney, Agent, or Firm*—Robert J. Van Der Wall

[57] ABSTRACT

Presented is a new rotary or cyclo-valve system for engines, such as internal combustion engines, that greatly simplifies the valve system for such engines. The cyclo-valve simply rotates to align its gas passageways with inlets to or outlets from engine cylinders in time with the combustion and exhaust cycles of the engine. The cyclo-valves themselves may be in the form of a rotary shaft, discs, or similar rotating elements. There are no valve lifters and no valve "float" at high engine rotational speeds as there are with state-of-the-art engines. Gas passageways, while preferred to be through the cyclo-valve, may also pass, at least partially, external to the cyclo-valve. In the preferred embodiment, sealing is at least partially accomplished by labyrinth seals. The instant invention cyclo-valve may be applied to all manner of engine including piston, rotary such as the Wankel, etc.

18 Claims, 3 Drawing Sheets

CYCLO-VALVE FOR INTERNAL COMBUSTION ENGINES

BACKGROUND OF THE INVENTION

Internal combustion engines, be they gasoline, diesel, natural gas, or other, require means to accurately control the amount of and the timing of injection of fuel/air mixtures and then the exhaust of the products of combustion during their operating cycles. Heretofore this has most commonly been done by more or less disc-shaped circular valves with stems that are individually opened at the required times with their operating force requirements supplied by cams or the like. This makes for a rather complex and expensive apparatus that adds much to the cost of basic engine. Newer design engines can have four valves per cylinder that translates to 32 complex valve systems for an eight-cylinder engine. Additionally, especially in the case of cam operated valves, there can be a condition referred to as "valve float" at high engine rotational speeds which places upper rotational speed limits on such engines.

There are also simple two cycle internal combustion engines that operate without valves. These valveless two cycle engines require a mixture of oil and gasoline for proper lubrication of bearings, piston rings and the like. Examples of such two cycle engines can be found today mainly in small engines used in lawn maintenance equipment and outboard motors. However, such two cycle engines generally will not pass current environmental requirements for emissions and are inherently inefficient. There are also internal combustion engines that use fuel injectors. While efficient, fuel injected engines have noticeably higher initial and maintenance costs.

The instant invention presents a far simpler and less expensive valve system concept than conceived heretofore. In the preferred embodiment, it employs a rotating element generally circular-shaped member, referred to herein as a cyclo-valve, that has ports or passageways that pierce it and/or operate around its periphery. Rotation of the cyclo-valve alternatively aligns a port with a cylinder of the parent engine. The cyclo-valve rotational speed is in time with engine rotational speed so that the cyclo-valve's ports are properly aligned for intake or exhaust of gases as required. Power requirements as well as complexity of the instant invention are both much less than that of present state-of-the-art engine cam or hydraulic driven valve lifter systems. This is because the instant invention's cyclo-valve design requires only low energy consumption rotational motion. The result of the instant invention is a more efficient and less costly engine that cannot encounter "valve float" at high engine rotational speeds. The result of being able to turn at higher engine rotational speeds is that smaller, lighter, and more efficient engines can be developed. A further embellishment to reduce initial and maintenance costs comes in the form of low cost non-wearing labyrinth gas seals that are offered in the preferred embodiment of the instant invention.

SUMMARY OF THE INVENTION

With the forgoing in mind, it is the principal object of the preferred embodiment of the present invention to provide a simple new rotary valve or cyclo-valve system for internal combustion engines that reduces the complexity and energy requirements of existing state-of-the-art engine valve systems.

A related object of the invention is that the instant invention shall increase horsepower output of a given engine displacement.

It is an object of the invention that its cylinder heads shall be lighter and smaller.

A further related object of the invention is that an engine utilizing the cyclo-valve design of the instant invention shall be lighter and less massive than a comparable power state-of-the-art engine.

It is yet another benefit of the instant invention that it can operate at higher rotational speeds than state-of-the-art engines.

A related object of the invention is that is shall have more efficient gas passage and better "breathing" at high rotational speeds than state-of-the-art engines.

It is a related object of the invention that the cyclo-valve system shall be in the form of a shaft with said shaft having gas passageways disposed through it.

It is a further related object of the invention that the gas passageways shall pass through the cyclo-valve shaft in a substantially transverse direction.

It is another related object of the invention that gas can pass around passageways formed between the outside of the cyclo-valve shaft and a gas passageway in a housing such as a cylinder head.

It is yet another object of the invention that openings and closings of cyclo-valve passageway that are in gaseous communication with a cylinder shall be time with piston position in the cylinder head.

It is a further object of the invention that sealing of the gas passageways and/or the cyclo-valve shall be accomplished, at least in part, by labyrinth seals or similar close tolerance fittings.

It is yet another object of the invention that other types of seals, such as contact seals, shall be also considered as usable.

An optional object of the invention utilizes rotary disc or otherwise shaped cyclo-valve members that are of a different diameter than their driving shaft and whereby gas passageways are in such valve members.

It is directly related object of the invention that gas can pass around passageways formed between the outside of the rotating disc-like cyclo-valve member and a gas passageway in a housing such as a cylinder head

BRIEF DESCRIPTION OF THE DRAWINGS

FIG. 5 is an enlarged partial view of FIG. 3 that shows the preferred embodiment of the cyclo-valve labyrinth seals 36 as disposed around the exhaust cyclo-valve 38. An additional more conventional contact seal 49 that adds to positive sealing ability is also shown here. Another detail is a venturi throat 50 that is incorporated as part of the outlet gas passageway 40 in the cyclo-valve 38. This optional venturi throat 50 offers a high efficiency way to control gas flows through the gas passageway.

DETAILED DESCRIPTION

Figure 1:
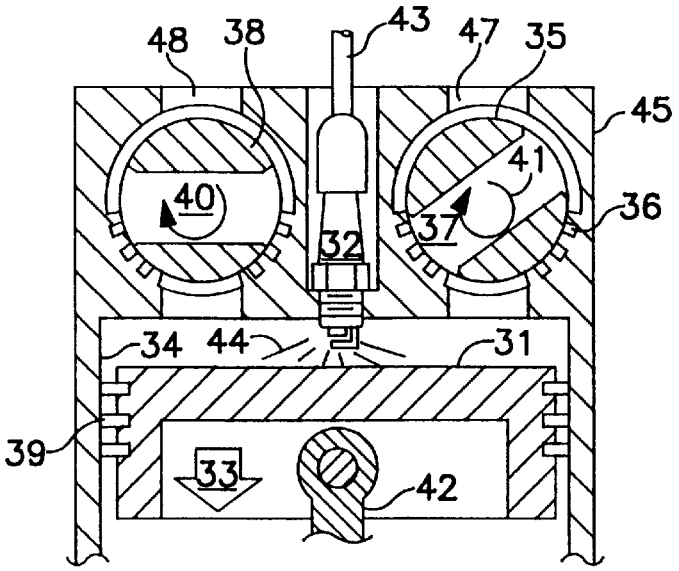
FIG. 1 presents a centerline cross-sectional view of a cylinder head that shows inlet and outlet rotary valves or cyclo-valves of the instant invention. In this stage of the engine's cycle, a spark plug has fired to thereby ignite a compressed gas mixture above the piston. The transversely oriented valve openings in the cyclo-valves are closed. While not shown, it is considered within the scope of the instant invention that gas passageways may at least in part pass around the outside of a cyclo-valve. Note that carburetors, exhaust systems, and the like have been omitted from the drawings for simplification since their locations would be obvious to someone skilled in the art. It is also to be noted that the instant invention cyclo-valves can be applied to other engine types such as the Wankel rotary engine, etc.

FIG. 1 presents a centerline cross-sectional view of a preferred embodiment of the instant invention. Shown in the cylinder head 45 are an inlet rotary valve or cyclo-valve 35 and its inlet valve passageway 37 and an outlet rotary valve or cyclo-valve 38 and its outlet valve passageway 40. The valve passageways 37, 40 are transversely oriented in the preferred embodiment of the invention. In this stage of the engine's cycle, a spark plug 32 has fired as is indicated by ignition spark s 44 to thereby ignite a compressed gas mixture above the piston 31. The piston 31 is starting its downward motion as is indicated by direction arrow 33. The valve openings 37, 40 in the cyclo-valve shafts are, of course, closed in this part of the illustrated four-cycle engine's cycle as they are not aligned with either the cylinder head inlet ports 47 or exhaust ports 48. Other items shown in FIG. 1 are the cylinder 34, connecting rod 42, piston rings 39, spark plug wire 43, valve rotation direction arrows 41, and cyclo-valve labyrinth seals 36.

Figure 2:
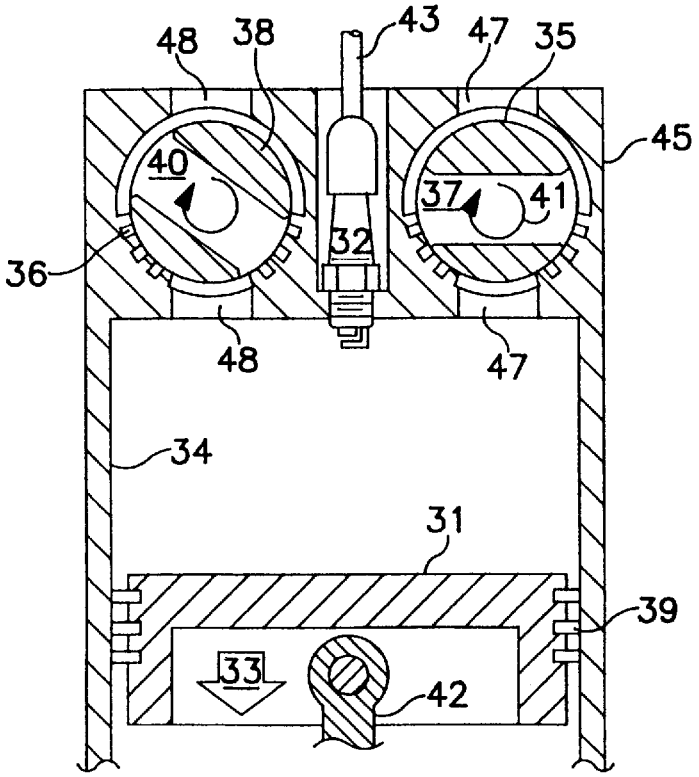
FIG. 2 shows the same cross-section as FIG. 1 but with the piston displaced lower as it is accelerating downward in its power stroke. The cyclo-valve openings, while at a different part of their rotation cycle, remain closed.

FIG. 2 presents the same centerline cross-sectional view as FIG. 1 but at a slightly later time where the piston 31 has traveled further down in the cylinder head 45. Note that while the cyclo-valves 35, 38 have rotated that the valve passageways 37, 40 are still not aligned with their corresponding cylinder head ports 47 and 48. Therefore, there is no gas flow as both valve passageways are closed.

Figure 3:
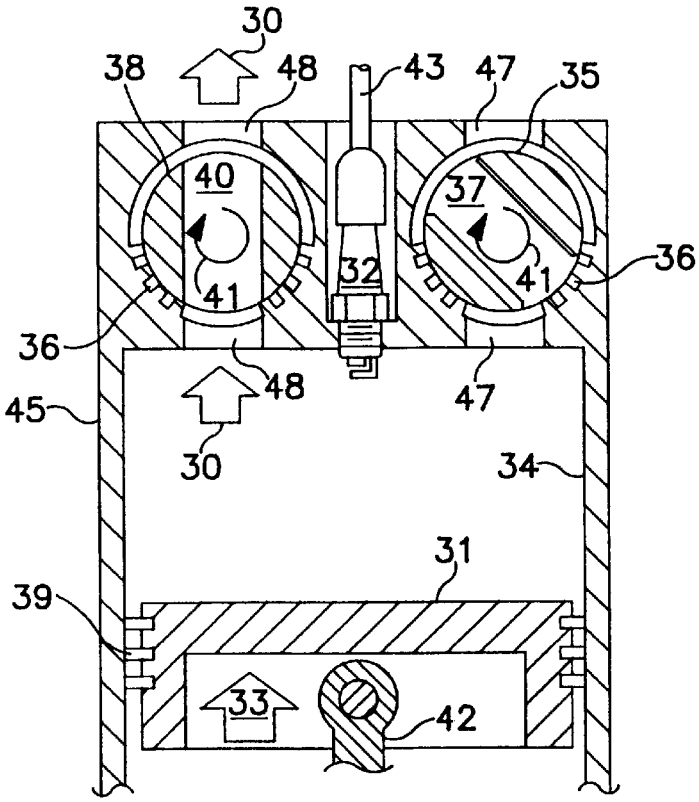
FIG. 3 gives the same cross-sectional view as FIGS. 1 and 2 but with the piston now traveling upward as it is now opening to exhaust the combusted gases from the cylinder. Note that the exhaust cyclo-valve is now oriented such that its exhaust valve opening is aligned with the exhaust ports in the cylinder head so that there is an open passageway for exhaust gas to freely flow outward.

FIG. 3 is yet another view that presents the same centerline cross-sectional view as FIGS. 1 and 2 but with the piston 31 moving upward as indicted by motion arrow 33 during the exhaust cycle of the engine. Note that the exhaust gas passageway 40 of the exhaust cyclo-valve 38 has rotated so that it is now oriented with the exhaust ports 48 in the cylinder head 45 to thereby allow free flow of exhaust gases out of the cylinder. Gas flow is indicted by gas flow arrow 30.

Figure 4:
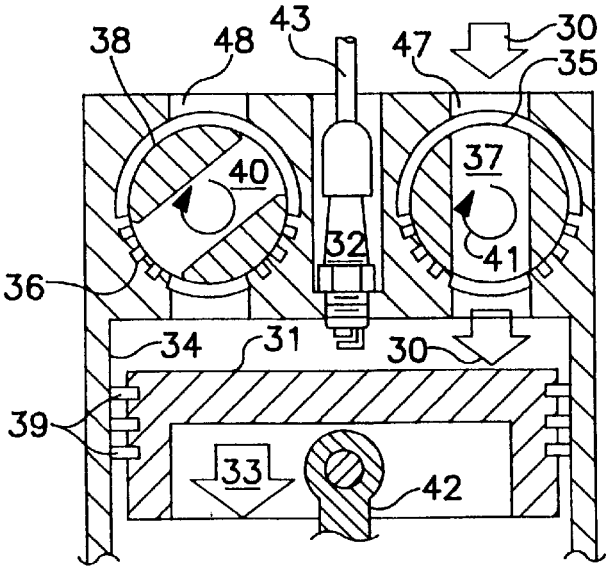
FIG. 4 presents the same cross-sectional view as FIGS. 1, 2, 3, and 4 but with the piston now near top-dead-center and starting downward. The intake cyclo-valve has its inlet valve opening aligned with the cylinder ports to allow easy gas flow through into the cylinder in this part of the engine's cycle. This downward motion of the piston draws the new gas mixture into the cylinder thereby starting another cycle. Note that while the piston/cylinder arrangement shown here illustrates a four-cycle piston engine that other engine types as well as engines with a different number of cycles are certainly considered within the spirit and scope of the instant invention.

FIG. 4 presents the same cross-sectional view as FIGS. 1, 2, 3, and 4 but with the piston 31 starting its downward movement to draw in a fresh new gas mixture as indicted by gas flow arrow 30. In this part of the engine's cycle, the inlet cyclo-valve 35 has rotated such that its gas passageway 37 is aligned with the inlet ports 47 in the cylinder head 45.

Figure 5:
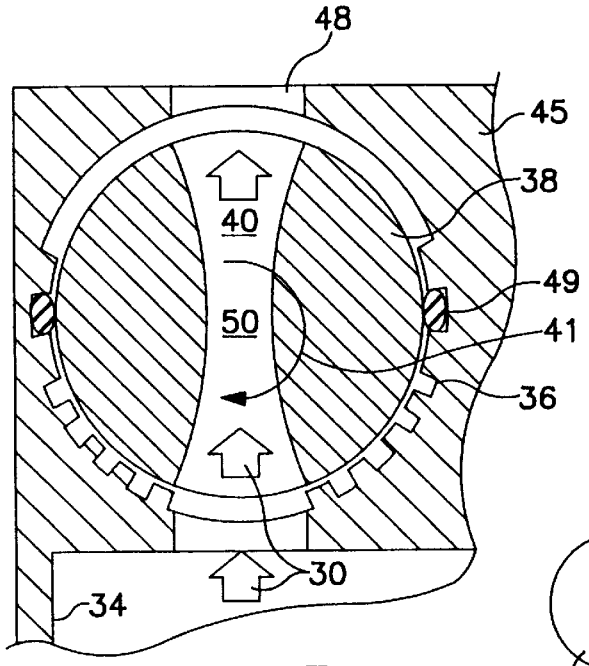
FIG. 5 is an enlarged partial view of FIG. 3 that shows the preferred embodiment of the cyclo-valve labyrinth seals as disposed around the exhaust cyclo-valve. An additional more conventional contact seal that adds to positive sealing ability is also shown here. Another detail is an optional venturi throat that is incorporated as part of the outlet gas passageway. This optional venturi-throat aids in controlling gas flow rates through the cyclo-valve.

FIG. 5 is an enlarged partial view of FIG. 3 that shows the preferred embodiment of the cyclo-valve's labyrinth seals 36 as disposed around the exhaust cyclo-valve 38. An additional more conventional contact seal 49 that adds to positive sealing ability is also shown here. Another detail is a venturi throat 50 that is incorporated as part of the outlet gas passageway 40 in the cyclo-valve 38. This optional venturi throat 50 offers a high efficiency way to control gas flows through the gas passageway.

Figure 6:
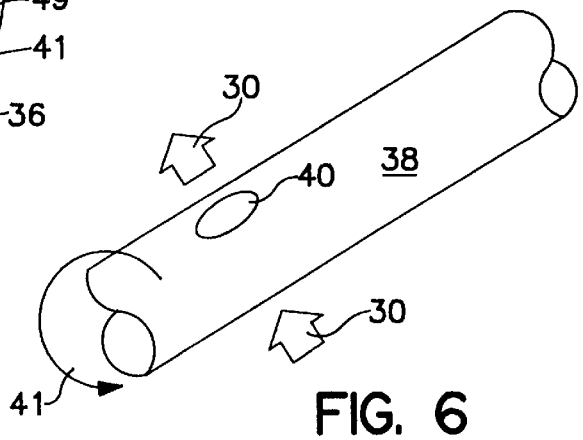
FIG. 6 shows a typical valve shaft as would be used in the preferred embodiment of the instant invention as was shown in FIGS. 1–5 which in this case is oriented to allow exhaust gases to escape.

FIG. 6 illustrates a typical cyclo-valve 38 as is part of the preferred embodiment of the instant invention shown in FIGS. 1 through 5. Note that in this case the exhaust gas is flowing through the cyclo-valve as is depicted by gas flow arrows 30. It is to be noted that while the illustrations shown in the drawings are for a single cylinder that multiple cylinder applications of the cyclo-valve are normal. A single continuous cyclo-valve can extend between cylinders or multiple single cylinder cyclo-valves can be interconnected between cylinders by way of gear teeth, cams, or the like.

Figure 7:
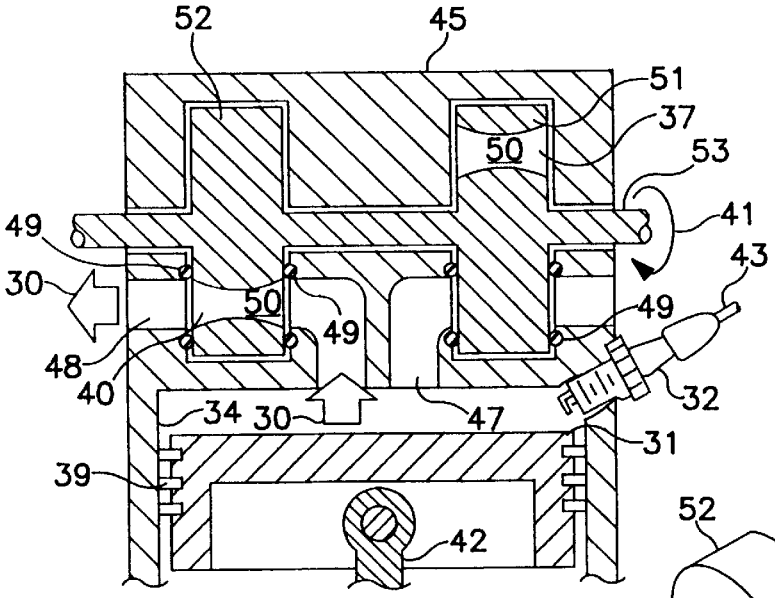
FIG. 7 presents an alternative concept of the instant invention cyclo-valve system. In this case, the gas passageways are disposed in discs and gas flow is through the discs.

FIG. 7 presents an alternative concept of the instant invention cyclo-valve that uses an inlet rotary disc 51 and an outlet rotary disc 52 that are rotated by shaft 53. In the part of the engine cycle illustrated here, the exhaust gas passageway 40 is aligned with the exhaust gas port 48 so that exhaust gas is dispensed from the cylinder 34. While contact seals 49 are shown here, other gas sealing means, including labyrinth seals, are usable.

Figure 8:
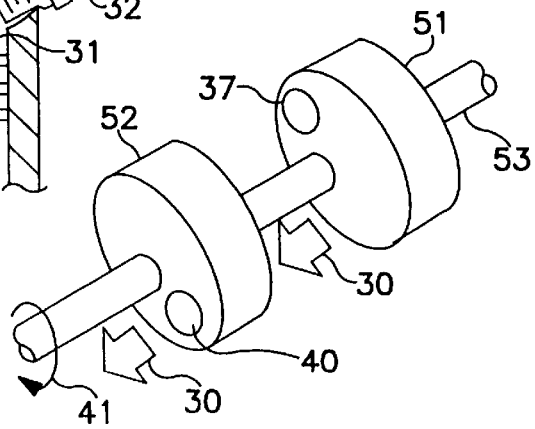
FIG. 8 illustrates the cyclo-valve system of the embodiment of the instant invention that was presented in FIG. 7. While not shown, it is considered within the scope of the instant invention that gas passageways may at least in part pass around the outside of the just described disc portion of this alternative embodiment of a cyclo-valve.

FIG. 8 shows a typical cyclo-valve system as is used in the version of the instant invention shown in FIG. 7. In this instance, the exhaust gas, as shown by gas flow arrows 30, is exiting through exhaust gas passageway 40.

While the invention has been described in connection with a preferred and several alternative embodiments, it will be understood that there is no intention to thereby limit the invention. On the contrary, there is intended to be covered all alternatives, modifications and equivalents as may be included within the spirit and scope of the invention as defined by appended claims, which are the sole definition of the invention.

What I claim is:

1. In an improved engine requiring timed fuel injection and exhaust, the improvement comprising:

an inlet cyclo-valve operating in timed sequence with a piston's position in a cylinder of said engine and an exhaust cyclo-valve operating in timed sequence with the piston's position in the cylinder of said engine whereby gas passage to and from said cylinder is, at least primarily, controlled by operation of said inlet and exhaust cyclo-valves, and wherein the gas passageway is at least partially venturi-shaped and passes through at least one of said cyclo-valves.

2. The improved engine of claim 1 wherein at least a portion of gas passage is around an outside of at least one of said cyclo-valves.

3. The improved engine of claim 1 wherein gas sealing of at least one of said cyclo-valves is at least partially accomplished by means of a labyrinth seal.

4. The improved engine of claim 1 wherein at least one of said cyclo-valves is at least partially a rotating disc.

5. The improved engine of claim 4 wherein said rotating disc includes a gas passageway.

6. The improved engine of claim 5 wherein said gas passageway is at least partially venturi-shaped.

7. In an improved engine requiring timed fuel injection and exhaust, the improvement comprising:

inlet and exhaust cyclo-valves on a common rotational axis with operation of said inlet and exhaust cyclo-valves in timed sequence with a piston's position in a cylinder of said engine whereby gas passage to and from said cylinder is, at least primarily, controlled by operation of said inlet and exhaust cyclo-valves, and wherein the gas passageway is at least partially venturi-shaped and passes through at least one of said cyclo-valves.

8. The improved engine of claim 7 wherein at least a portion of gas passage is around an outside of at least one of said cyclo-valves.

9. The improved engine of claim 7 wherein at least one of said cyclo-valves is at least partially a rotating disc.

10. The improved engine of claim 9 wherein said rotating disc includes a gas passageway.

11. The improved engine of claim 10 wherein said gas passageway is at least partially venturi-shaped.

12. The improved engine of claim 7 wherein gas sealing of at least one of said cyclo-valves is at least partially accomplished by means of a labyrinth seal.

13. In an improved engine requiring timed fuel injection and exhaust, the improvement comprising:

inlet and exhaust cyclo-valves with operation of said inlet and exhaust cyclo-valves in timed sequence with a firing cycle of said engine whereby gas passage to and from said engine is, at least primarily controlled by operation of said inlet and exhaust cyclo-valves, and wherein the gas passageway is at least partially venturi-shaped and passes through at least one of said cyclo-valves.

14. The improved engine of claim 13 wherein at least a portion of gas passage is around an outside of at least one of said cyclo-valves.

15. The improved engine of claim 13 wherein gas sealing of at least one of said cyclo-valves is at least partially accomplished by means of a labyrinth seal.

16. The improved engine of claim 13 wherein at least one of said cyclo-valves is at least partially a rotating disc.

17. The improved engine of claim 13 wherein said rotating disc includes a gas passageway.

18. The improved engine of claim 17 wherein said gas passageway is at least partially venturi-shaped.

* * * * *